US006517468B1

(12) United States Patent
Lapcevic

(10) Patent No.: US 6,517,468 B1
(45) Date of Patent: Feb. 11, 2003

(54) EXERCISE DEVICE

(76) Inventor: Thomas G. Lapcevic, 32 White Birch Cir., Pittsburgh, PA (US) 15220

( * ) Notice: Subject to any disclaimer, the term of this patent is extended or adjusted under 35 U.S.C. 154(b) by 0 days.

(21) Appl. No.: 09/514,105

(22) Filed: Feb. 28, 2000

(51) Int. Cl.[7] ..... A63B 21/08
(52) U.S. Cl. ..... 482/51; 482/97; 482/100
(58) Field of Search ..... 482/92–94, 51, 482/97–100, 136, 137, 908

(56) References Cited

U.S. PATENT DOCUMENTS 5,286,243 A * 2/1994 Lapcevic ..... 482/97
5,624,353 A * 4/1997 Naidus ..... 482/5
5,755,645 A * 5/1998 Miller et al. ..... 482/115

* cited by examiner

*Primary Examiner*—Glenn E. Richman

(74) *Attorney, Agent, or Firm*—Webb Ziesenheim Logsdon Orkin & Hanson, P.C.

(57) ABSTRACT

An exercise device includes: a support frame, a first shaft rotatably supported on the support frame, a user interface member connected to the first shaft which, when displaced by a user, causes the first shaft to rotate more than 90 degrees and a second shaft rotatably supported on the support frame. A linkage mechanism connects the first shaft and the second shaft, thereby controlling the relative rates of rotation of the first and second shafts. The exercise device also includes a torque arm assembly having an upper torque arm and a lower torque arm connected to the second shaft at different predetermined angular positions. Each torque arm includes at least one weight support member thereon. The relative positions of the connections within the linkage mechanism are coordinated with the relative angular positions of each torque arm to provide desired resistance curves for each of the torque arms. Preferably, the resistance generated by the linkage mechanism and torque arm assembly does not result in a negative resistance force at any point during the rotation of the first shaft.

12 Claims, 6 Drawing Sheets

TYPICAL INITIAL CONFIGURATION FOR LINKAGE ASSEMBLY

INPUT VARIABLES FOR PROGRAM FOR LINKAGE ASSEMBLY

STEPPING THROUGH ANGLE APPLIED AT 'A'

EXERCISE DEVICE

FIELD OF THE INVENTION

The present invention relates to exercise devices used on the human body and, more particularly, to exercise devices wherein the resistance curve experienced by the human body can be selectively and easily adjusted.

BACKGROUND OF THE INVENTION

Most exercise devices provide only a single resistance curve that cannot be altered to conform to individual requirements. Recently, a number of exercise devices have been developed that enable resistance curves to be varied. However, those exercise devices suffer from a number of practical and functional limitations. For example, negative forces often result during the range of motion of the exercise device which can lead to less than optimal conditioning and loss of control of the exercise device by the user.

U.S. Pat. No. 5,286,243 discloses an exercise device combining the resistance generated by a plurality of torque arms with a conversion mechanism that creates a greater degree of rotation of the torque arms than that of the exercise arm. It is possible, through proper relative placement of weights along designated torque arms, to achieve desirable resistance curves. However, both positive and negative resistance forces are possible during the exercise motion. Consistently maintaining a desired resistance curve and consistently maintaining a positive resistance load throughout the exercise motion requires proper adjustment of numerous torque arm variables. The proper adjustment of such variables may in many cases be beyond the patience and/or the knowledge of the average exercise equipment user.

U.S. Patent Application Ser. No. 08/609,244, the disclosure of which is incorporated herein by reference, discloses an exercise device in which resistance curves can be selectively varied and controlled to achieve a desired positive resistance curve notwithstanding the degree of rotation of the exercise motion. In that exercise device, a user interface member (or exercise member) is connected to a first shaft such that when the user interface member is displaced by a user the first shaft is caused to rotate. A second shaft is also rotatably supported on a support frame of the device. A torque arm assembly including a plurality of torque arms (for supporting weight members) are connected to the second shaft. A conversion mechanism connects the first and the second shafts to limit the degree of rotation of the second shaft in such a manner that the resistance generated by the torque arm assembly cannot result in a negative resistance force regardless of the loading of the torque arms.

In general, the conversion mechanism of U.S. Patent Application Ser. No. 08/609,244 is a beltwheel assembly. Beltwheel assemblies provide the advantage of effecting a linear or constant conversion of the degree of rotation between the user interface member (or exercise arm) and the torque arm assembly. Thus, the normalized resistance curve or strength curve for each of the torque arms is unaffected by the beltwheel conversion mechanism. Nonetheless, beltwheel conversion mechanisms suffer from a number of significant drawbacks. For example, belt wheel assemblies can be expensive and difficult to manufacture. Moreover, deformation of the belt during use thereof can affect the conversion. Likewise, the belts of beltwheel assemblies are prone to failure/breakage during use, giving rise to the potential for injury to the user.

It is very desirable to develop exercise devices that reduce or eliminate the drawbacks associated with current exercise devices.

SUMMARY OF THE INVENTION

The present invention provides an exercise device in which resistance curves can be selectively varied and controlled. The present invention includes a torque arm assembly that preferably comprises a plurality of torque arms or pegs positioned at different radial positions along a radius of rotation of the torque arm assembly such that the relevant placement of weight members on the torque arms results in an endless array of resistance curves. In any such resistance curve, the present invention preferably continuously maintains a positive resistance force regardless of the manner of loading of the torque arms.

In general, the present invention provides an exercise device for generating a plurality of resistance curves including a support frame and a torque arm assembly rotatably connected to the support frame via, for example, a rotating shaft of the torque arm assembly. As described above, the torque arm assembly includes a plurality of torque arms. Each of the plurality of torque arms includes a support member to position a weight member thereon. A user interface member is connected to an exercise arm or shaft. Displacement of the user interface by the use of the exercised device causes the exercise arm to rotate. A conversion mechanism including a linkage assembly operatively connects the exercise arm and the torque arm assembly. The conversion mechanism controls the degree of rotation of the torque arm assembly as a function of the rotation of the exercise arm.

The linkage assembly of the conversion mechanism is preferably adapted to provide a generally optimized desired normalized resistance or torque curve as experience by the user (that is, torque as measured at the exercise arm) for each of the torque arms. In that regard, the nonlinear conversion of the linkage assembly and the sinusoidal variation of each of the torque arms is combined to provide a simultaneously optimized resistance curve for each of the torque arms.

The linkage assembly of the present invention provides a number of advantages over beltwheel assembly conversion mechanisms used in current exercise devices. For example, linkage assemblies are stronger than belt wheel assemblies and do not wear/fail with repeated use over extended periods of time. Moreover, the linkage assemblies of the present invention are relatively simple and inexpensive to manufacture.

A number of currently available exercise devices utilize linkage assemblies to connect an exercise arm to a weight assembly. Unlike such exercise devices, the multiple defined torque curves (as determined by the multiple torque arms of the torque arm assembly) of the present invention, the relatively large conversion ratios of the conversion mechanism of the present invention, and/or the relatively large range of motion of the exercise arm and/or the torque arm greatly complicate the design of the linkage assembly. Indeed, the inherent nonlinearity of linkage assemblies can substantially and undesirably alter the sinusoidal resistance curves (that is, the torque on the exercise arm) resulting from a rotating torque arm assembly. In that regard, the resistance and the rate of change of that resistance experienced by the user over the range of motion of the exercise arm is a sum of the effects of the sinusoidal torque resulting from rotation of the torque arm assembly and the nonlinear conversion of the sinusoidal torque by the linkage assembly. Because of their inherent nonlinearity, linkage assemblies have typically been used in exercise devices in cases wherein (i) there is an approximately 1:1 correspondence between the range of motion of the exercise arm and the torque arm assembly (a conversion ratio of 1.0); (ii) the range of motion of the exercise arm and/or the torque arm assembly is relatively limited (generally, less than approximately 50 degrees); (iii) and/or the torque arm assembly can be loaded at only a single position.

In that regard, matching a single load curve to a single load force curve using a linkage assembly as done in a number of other exercise devices is relatively simple. For example, if the nonlinearity of a linkage assembly in such an exercise device is such that the user interface arm and the load or torque arm assembly are rotating in the correct angle, but the force curve is incorrect, the designer can simply rotate the weight loading point (for example, a torque arm or weight peg) to a different angle on the arc of rotation of the torque arm assembly to match the load curve to the linkage curve and give the desired resistance curve. In the case that the torque arm assembly has multiple loading positions as in the exercise device of the present invention, however, one cannot merely/solely rotate such multiple loading points along the arc of rotation of the torque arm assembly to provide the desired force curve for each of the multiple loading points (particularly if negative torques/forces are to be avoided). Simply, relocating the weight points or pegs to different positions on the rotation of the torque arm assembly (as done in current, single-loading-point linkage assembly systems) results in resistance curves that do not match the desired resistance curves (for example, the resistance curves that would result in a linear conversion for given positions of the torque arms) because of the limited space and/or the nonlinear physics of the conversion mechanism. In the case of three loading positions, for example, one has three variable positions and three desired/ideal force curves. Furthermore, the rate of change in the force and/or the direction of that change (that is, a positive or a negative change) are different for each force curve as determined by the position/angle of the torque arm on the sinusoidal curve. Prior to the present invention, combining such multiple nonlinear, sinusoidal torque changes with the nonlinear conversion of a linkage mechanism to achieve a desirable resistance curve for each torque arm was not attempted for the conversion ratios and ranges of motion of the present invention.

Moreover, the greater the degree of conversion between the range of motion of the exercise arm and the range of motion of the torque arm assembly(that is, the more the conversion ratio varies from 1), the greater the nonlinearity that arises from a linkage assembly. Likewise, the greater the range of motion of the exercise arm assembly and/or the torque arm assembly, the greater the nonlinearity that arises from a linkage assembly. Generally, in the case that the conversion ratio is approximately 1 and/or the range of motion of the exercise arm assembly and the torque arm assembly are less than approximately 50 degrees, the nonlinearity of the conversion can be ignored even in the case of a torque arm assembly having multiple loading points.

As used herein, the term "conversion ratio" refers generally to the range of motion (in degrees) of the exercise arm divided by the range of motion (in degrees) of the torque arm assembly. Thus, in an exercise device in which the exercise arm assembly rotates 140 degrees and the torque arm assembly rotates 70 degrees, the conversion ratio is 2.0. In an exercise device in which the exercise arm assembly rotates 70 degrees and the torque arm assembly rotates 140 degrees, the conversion ratio is 0.5.

The present inventor has surprisingly discovered that it is possible adapt a linkage assembly to provide a desired resistance curve for each of a plurality of torque arms on a rotating torque arm assembly, while preventing negative resistance for any loading of the torque arms. The present inventor has discovered that such multiple desirable resistance curves can be achieved even if (i) the conversion ratio significantly deviates from 1, and/or (ii) the range of motion of the exercise arm assembly and/or the torque arm assembly is greater than approximately 50 degrees.

In one aspect the present invention provides an exercise device for generating a plurality of resistance curves including: a support frame, a first shaft rotatably supported on the support frame; a user interface member connected to the first shaft which, when displaced by a user, causes the first shaft to rotate more than 90 degrees and a second shaft rotatably supported on the support frame. A linkage mechanism (inherently causing a variable resistance force over the range of motion thereof) connects the first shaft and the second shaft, thereby controlling the relative rates (and degrees) of rotation of the first and second shafts.

The exercise device also includes a torque arm assembly having an upper torque arm and a lower torque arm connected to the second shaft at different predetermined angular positions. Each torque arm includes at least one weight support member thereon.

The relative positions of the connections within the linkage mechanism are coordinated with the relative angular positions of each torque arm such that when the user interface member is displaced by the user and a weight member is placed on the upper torque arm, the aggregate effect of the linkage mechanism and upper torque arm causes: (i) a maximum torque to be applied to the first shaft at some point during the first 45 degrees of rotation of the first shaft; and (ii) a minimum torque to be applied to the first shaft at some point during the last 45 degrees of rotation of the first shaft. Likewise, the relative positions of the connections within the linkage mechanism are coordinated with the relative angular positions of each torque arm such that when the user interface member is displaced by the user and a weight member is placed on the lower torque arm, the aggregate effect of the linkage mechanism and lower torque arm causes: (i) a maximum torque to be applied to the first shaft at some point during the last 45 degrees of rotation of the first shaft; and (ii) a minimum torque to be applied to the first shaft at some point during the first 45 degrees of rotation of the first shaft.

Preferably, the resistance generated by the linkage mechanism and torque arm assembly does not and, indeed cannot, result in a negative resistance force at any point during the rotation of the first shaft.

In another embodiment, the exercise device includes another torque arm at an angular position intermediate to the upper torque arm and the lower torque arm. Multiple intermediate torque arms can be provided. The relative positions of the connections within the linkage mechanism are coordinated with the relative angular position of the intermediate torque arm such that when the user interface member is displaced by the user and a weight member is placed on the intermediate torque arm, the aggregate effect of the linkage mechanism and intermediate torque arm causes a maximum torque to be applied to the first shaft at some point during the middle 45 degrees of rotation of the first shaft.

In one aspect of the present invention, the linkage assembly of the conversion mechanism of the present invention is preferably adapted or adjusted to reduce or to optimize the effect thereof on a normalized torque curve resulting for each of several torque arms positioned at different angular positions. As used herein, the phrase "normalized torque curve" refers generally to the percent of maximum resistance experienced at the various points along the range of motion of a torque arm. In other words, in this aspect of the present invention, the nonlinearity of the conversion of the linkage assembly is preferably reduced or optimized over the range of motion of the exercise arm for the torque arms. The position of each of the torque arms can also be altered to further alter the corresponding resistance curves to arrive at a desire result.

Surprisingly, the above results can be accomplished even if the conversion ration is greater than approximately 1.25. The conversion ratio can even be greater than approximately 1.5. Indeed, the conversion ratio can even be greater than approximately 1.75 Furthermore, the results can be accomplished even in the case that the range of motion of either the exercise arm or the torque arm is greater than 50 degrees. Indeed, the results can be accomplished even in the highly desirable case that the range of motion of the exercise arm is greater than 90 degrees.

In the present invention, the multiple uniquely defined strength/torque curves of the torque arm assembly are preferably matched to or combined with the linkage assembly curve to provide a desired composite resistance curves by mapping the points of rotation of the links of the linkage assembly into two dimensional space and studying the resistance/torque experienced by the user (at the exercise arm) at incremental positions along the range of motion of the exercise arm for each of a plurality of torque arms positioned at different angular orientation for each set of such points. In that regard, the method preferably further includes the steps of: changing the location of at least one of the points of rotation in two-dimensional space to create at least a second set of point; and studying the force curve experienced by the exercise arm at incremental positions along the range of motion of the exercise arm for the second set of points. These steps are preferably repeated to reduce the effect of the linkage assembly on the sinusoidal resistance curves experienced at the exercise arm. The present inventor has discovered that the linkage assemblies of the present invention can be relatively quickly designed/optimized by studying the effect of moving the position or such points or rotation in two-dimensional space (the third, dimension can generally be ignored for the purposes of this study). Preferably, one of the points of rotation (for example, the point about which the torque arm assembly rotates) is preferably used as reference point or origin in the two-dimensional space. Once the position of each of the points of rotation is determined/optimized, this result provides the relative positions and lengths/structure of the links required. The results of this optimization can be scaled to larger dimensions than those used in the study. Moreover, the angular position of one or more of the torque arms can also be changed to provide the desired resistance curve.

Other details, objects and advantages of the present invention will become apparent as the following detailed description of preferred embodiments of practicing the invention proceeds.

DETAILED DESCRIPTION

Figure 1:
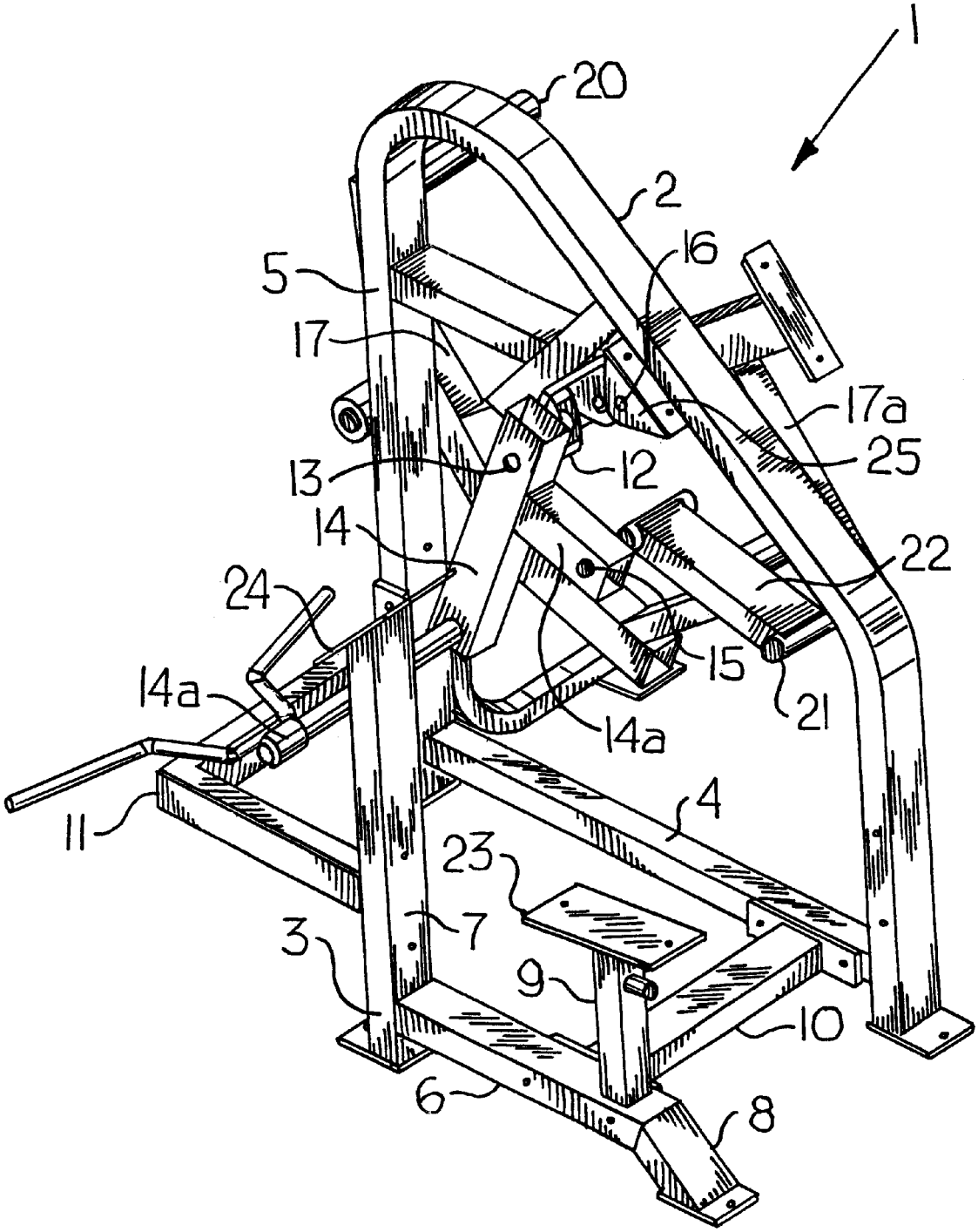
FIG. 1 illustrates a perspective view of an embodiment of an exercise machine of the present invention.

In general, the exercise devices of the present invention include a frame upon which a torque arm assembly is rotatably supported. A user interface member is connected to an exercise arm or shaft which is connected to the torque arm assembly via a conversion mechanism such that when the user interface member is displaced by a user, the torque arm assembly is caused to rotate. The torque arm assembly preferably includes a shaft to which are connected a plurality of torque arms or weight loading position. Each of the plurality of torque arms is preferably adapted to support a weight member thereon. Preferably, the torque arms are positioned at different location on the arc of rotation of the shaft of the torque arm assembly. The conversion mechanism connects the user exercise arm to the torque arm assembly to control the degree of rotation of the torque arm assembly relative to the degree of rotation of the exercise arm.

Preferably, the rotation of the torque arm assembly is controlled in such a manner that the resistance generated by the torque arm assembly cannot result in a negative resistance force (as experienced by the user of the exercise device). In preventing a negative resistance force, the conversion mechanism may either limit or magnify the rotation of the torque arm assembly, provided that in no case is the rotation of the torque arm assembly sufficient to create a negative resistance force.

The conversion mechanism of the present invention includes a linkage assembly. As used herein, the term "linkage assembly" refers generally to rigged members or links that are rotatably coupled to each other. The degree of conversion (that is, the change in the degree of rotation between the user interface and the torque arm assembly) is generally a function of the relative lengths and angles of the links in the assembly.

The linkage assembly of the conversion mechanism is preferably designed so that the maximum degree of rotation applied to the exercise arm assembly by the exercise motion of the user is converted to no more than approximately 90 degrees of rotation of the torque arm assembly. More preferably, the maximum degree of rotation applied by the exercise motion of the user is converted to no more than approximately 70 degrees of rotation of the torque arm assembly.

Preferably, the angle between the outermost torque arms or loading points (relative to the point of rotation of the torque arm) is no more than 90 degrees. Preferably, the torque arm assembly includes three torque arms wherein the angle between each torque arm is approximately 35 degrees.

In that embodiment, the angle between the outermost torque arms is approximately 70 degrees.

In one embodiment of the present invention, the torque arm assembly is preferably positioned such that the uppermost torque arm applies a maximum resistance force to the user when the user interface or exercise arm is in the vicinity of its initial or starting position (preferably, in the first 45 degrees of rotation of the exercise arm) and a minimum when the exercise arm is in the vicinity of the end of its range of motion (preferably, in the last 45 degrees of rotation of the exercise arm).

In the case of a linear conversion, the upper torque arm is preferably located at either the 3 o'clock position or the 9 o'clock position depending upon the direction of rotation in its initial position. That is, the upper torque arm is preferably generally horizontal in its initial position. Because the conversion mechanism preferably assures that the torque arm assembly will rotate no more than 90 degrees (and, more preferably, no more that 70 degrees), the torque arm assembly will never generate a negative resistance force regardless of the manner of the loading of the torque arms by the user.

In a range of motion of 70 degrees for the torque arm assembly in the embodiment discussed above, a middle torque arm (offset from the uppermost torque arm and the lowermost torque arm by approximately 35 degrees) preferably provides a maximum resistance to the torque arm assembly generally in the vicinity of the center of the range of motion (preferably, somewhere within the middle 45 degrees of rotation or within approximately 22.5 degrees of the center of rotation of the exercise arm). The lower most torque arm preferably provides a minimum resistance in the vicinity of the start of the range of motion (preferably, within 45 degrees of the start) and a maximum resistance in the vicinity of the finish of the range of motion (preferably, within 45 degrees of the end of the range or motion)

The above described case, in which one resistance curve generally begins at a maximum and ends and ends at a minimum, one resistance curve generally achieves a maximum in the vicinity of a midpoint, and one resistance curve generally begins at a minimum and ends at a maximum, is particularly advantageous in providing almost any resistance curve to the user of the exercise device. In the case of a nonlinear conversion mechanism such as a linkage assembly, it may be desirable to change the angular orientation of one or more of the torque arms to provide the three desired resistance curves.

A support member for securing at least one weight member is preferably affixed to each torque arm. In its simplest form, this weight support is a peg upon which weight plates can be held. It is also possible to have weight members slide along the torque arms to selected positions to create an adjustable resistance force that does not require the removal of the weight members.

In the operation of the present invention, each weight member supported on a torque arm assembly provides a torque that follows a generally sinusoidal curve. If a single torque arm is loaded, the force generated will follow the sinusoidal curve associated with that torque arm. Should more than one torque arm be loaded, the force generated will follow the vector summation of the sinusoidal curves associated with each of the torque arms that are loaded. Thus, the torque assembly permits the user to vary the overall resistance force depending upon the relative placement of weight members on the torque arms.

As discussed above, the conversion mechanism preferably assures that the torque arm assembly the proper degree of rotation regardless of the degree of rotation of the user interface or exercise member. To determine an appropriate conversion ratio for any given exercise unit and its associated exercise motion, the desired degree of rotation of the exercise motion is determined and the conversion ratio is set accordingly (preferably to prevent negative resistance).

For example, assuming that the average exercise motion is 140 degrees, the conversion mechanism in the above example preferably imparts approximately 70 degrees of rotation to the torque arm assembly. The starting position of the torque arm assembly is preferably located such that the upper torque arm is approximately horizontal. In a preferred embodiment, the second torque arm is approximately 35 degrees toward vertical from the first torque arm, and the third torque arm is approximately 35 degrees toward a downward oriented, vertical axis from the second torque arm. The positioning of the torque arm assembly in this manner, together with the 2:1 ratio of rotation (140 degrees/70 degrees) between the user interface and the torque arm assembly, assures that the user will always experience a positive resistance force during the course of the exercise motion, regardless of the manner in which the torque arms are loaded.

By varying the relative loading of the torque arms, an indefinite number of resistance curves can be achieved. The use of a plurality of torque arms is a substantial improvement over the case of a single torque arm in which only a single sinusoidal resistance curve is attainable. Assuming the user desires to overload the beginning of the exercise motion, the user loads the upper torque arm. In the case of a linear conversion, this loading results in the user ideally experiencing approximately 100% of the resistance at the beginning of the motion and approximately 34% at the end of the motion. If the user wants to overload the middle of the motion, the user loads the middle torque arm. In the case of a linear conversion, this loading results in the user ideally experiencing approximately 82% of the resistance at the beginning of the motion, approximately 100% of the resistance in the middle of the motion and approximately 82% at the end of the motion. To overload the end of the motion the user loads the lower torque arm. In the case of a linear conversion, this loading results in the user ideally experiencing approximately 34% of the resistance at the beginning of the motion and approximately 100% of the resistance at the end of the motion.

By loading more than one arm, for example the upper torque arm and the middle torque arm, the user will experience the vector sum effect of the sinusoidal curves generated by the upper and middle torque arms. Thus, the user will experience maximum resistance somewhere between the beginning and the middle of the motion, depending upon the relative ratios of the weights on the two torque arms. A middle to end overload would occur if the middle and lower torque arms were each loaded.

The present invention thus preferably provides incredible variability while preferably never allowing the user to experience the risks associated with negative loading. The combination of the conversion mechanism of the present invention with a properly positioned torque assembly having multiple torque arms conveniently, simply and safely enables satisfaction of the resistance pattern needs of any user.

Figure 2:
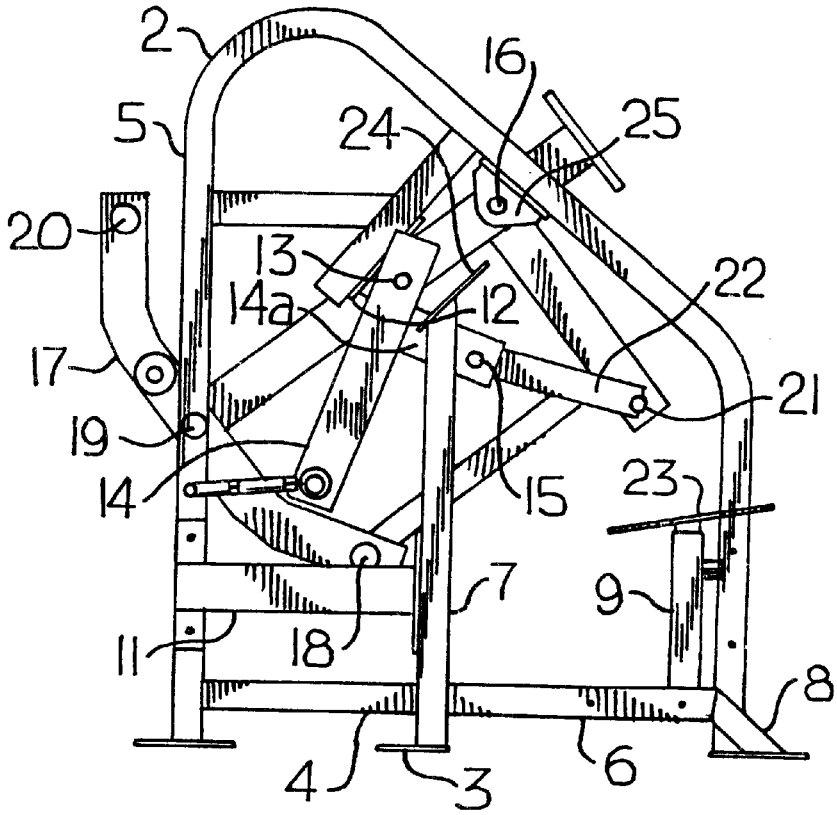
FIG. 2 illustrates a side view of the exercise device of FIG. 1.

Referring to the drawings wherein preferred embodiments of the present invention are shown for illustrative purposes only and not for the purpose of limiting the same. FIGS. 1 and 2 illustrate a weight lifting exercise device 1, which may occupied by a user. Exercise device 1 preferably includes a support frame including a power frame 2 (which generally supports a torque arm assembly comprising a rotating shaft 17 and the conversion mechanism) as well as an exercise frame 3 (which generally supports the user of exercise device 1). Power frame 2 preferably includes a lateral base frame member 4 and a longitudinal frame member 5 suitable for support on, for example, a flooring surface. Exercise frame 3 preferably includes a lateral base frame member 6 and longitudinal frame members 7 and 8 suitable for support on, for example, a flooring surface. Exercise frame 3 further preferably includes parallel forward and rear generally vertical frame members 7 and 9, which support longitudinal frame members 24, and a seat member 23. Power frame 2 and exercise frame 3 are preferably connected by lateral base cross support members 10 and 11.

In the embodiment of FIGS. 1 and 2, power frame 2 supports a first set of bearings 12 flanked on either side of inside front of frame member 5 and inside portion of the power frame 2. Rotatably supported by first set of bearings 12 is a first generally horizontal rotatable shaft 13. Radially attached to first rotatable shaft 13 is an exercise arm 14, which is connected to a user interface 14' via a connecting member 14". User interface 14' is engaged by the user during the exercise motion. Exercise arm 14 rotates about a point A defined by the center of shaft 13 (see FIG. 3) during the exercise motion. A second shaft 15 is attached at a predetermined position (point B in FIG. 3) fixed relative to point A. In the embodiment of FIGS. 1 and 2, shaft 15 is rotatably connected to an extending member 14*a* of exercise arm 14.

Power frame 3 also supports a second set of bearings 25 flanked on either side and secured to the power frame 3 positioned behind the first set of rotatable bearings 12. Rotatably supported by the second set of rotatable bearings 15 is a second rotatable shaft 16. Attached to the second rotatable shaft 16 is a torque arm assembly preferably including a rotating shaft 17 having connected thereto three torque arm weight pegs 18, 19 and 20 with an angle preferably at least approximately 20 degrees and, more preferably approximately 35 degrees, between each torque arm weight pegs. Torque arm assembly shaft 17 rotates about a point D (see FIG. 3) defined by the center of shaft 16 during the exercise motion. Although the torque arm assembly is depicted as comprising three torque arm weight pegs 18, 19, & 20, it can include two torque arm weight pegs or more than three torque arm weight pegs. Likewise the angles between the torque arm weight pegs need not be constant. The angle between each of torque arms weight pegs is preferably at least 20 degrees to provide an easily noticeable resistance curve difference when adjacent torque arm pegs are differently loaded. Also attached to the torque arm assembly is a third shaft 21 located a fixed predetermined distance and angle from torque arm shaft 16. In the embodiment of FIGS. 1 and 2, third shaft 21 is rotatably connected to an extending member 17*a* that is connected to torque arm assembly shaft 17. Third shaft 21 rotates radially around shaft 16 on a predetermined arcuate path based on the rotation of the torque arm assembly shaft 17 during the exercise movement of the exercise.

Figure 3:
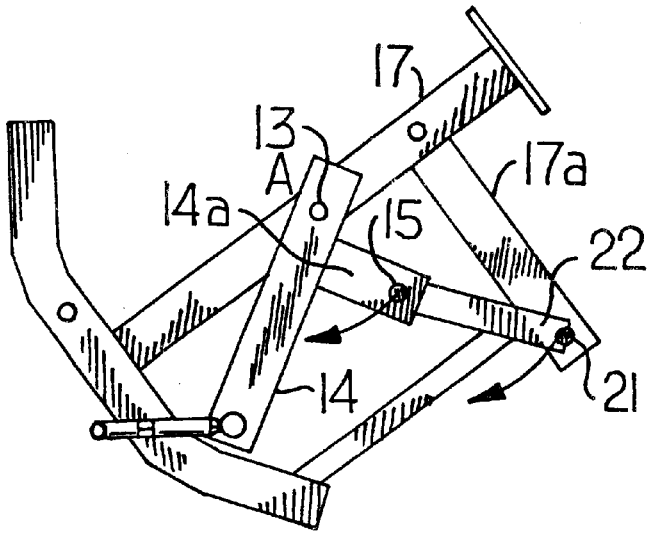
FIG. 3 illustrates a side view of the exercise member, linkage assembly and torque arm assembly of the exercise device of FIG. 1.
Figure 4:
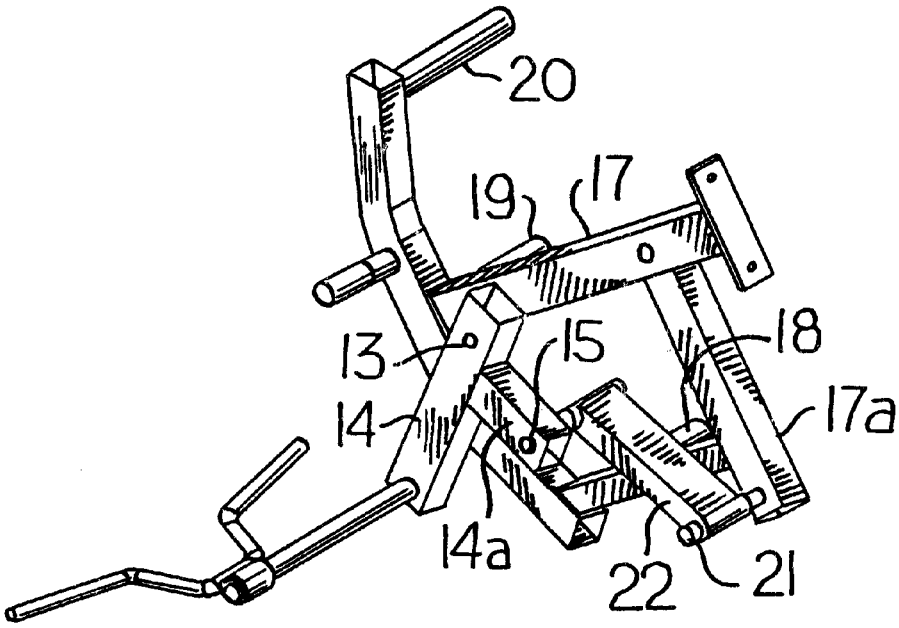
FIG. 4 illustrates a perspective view of the exercise member, linkage assembly and torque arm assembly of the exercise device of FIG. 1.
Figure 5:
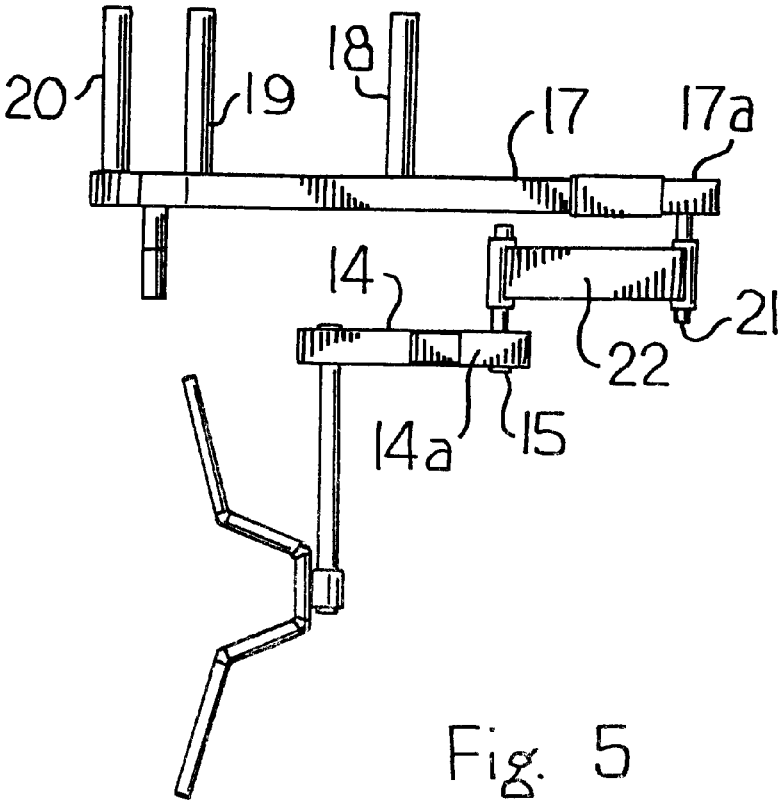
FIG. 5 illustrates a top plan view of the exercise member, linkage assembly and torque arm assembly of the exercise device of FIG. 1.

Torque arm assembly shaft 17 is preferably positioned at a predetermined distance in relation to the exercise arm 14. A predetermined sized link 22 rotatably couples the exercise arm 14 to the torque arm assembly shaft 17 so that when the user moves exercise arm 14 through a certain angle of rotation, torque arm assembly shaft 17 will move a certain angle in respect to exercise arm assembly shaft 14. The exercise arm assembly and torque arm assembly of FIGS. 1 and 2 are also illustrated in FIGS. 3, 4 and 5.

Figure 6:
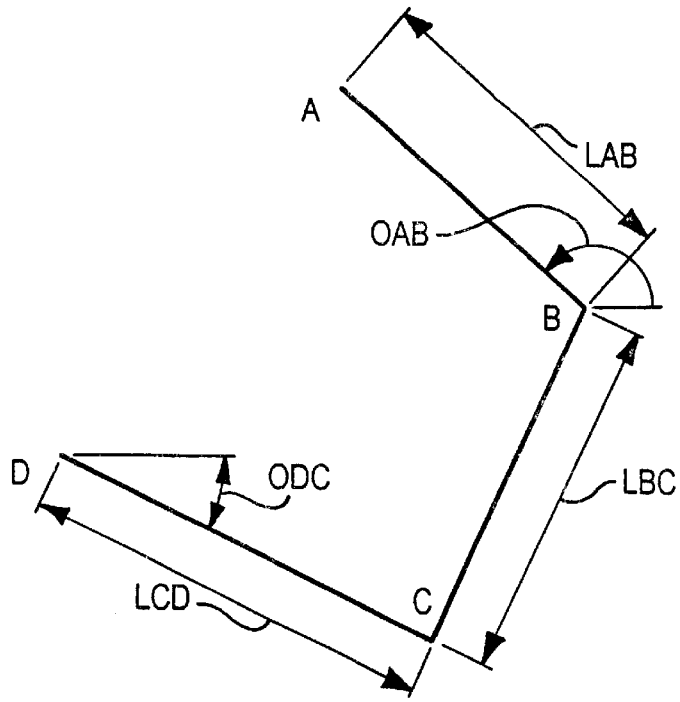
FIG. 6 illustrates an initial configuration for the linkage assembly of the present invention.
Figure 7:
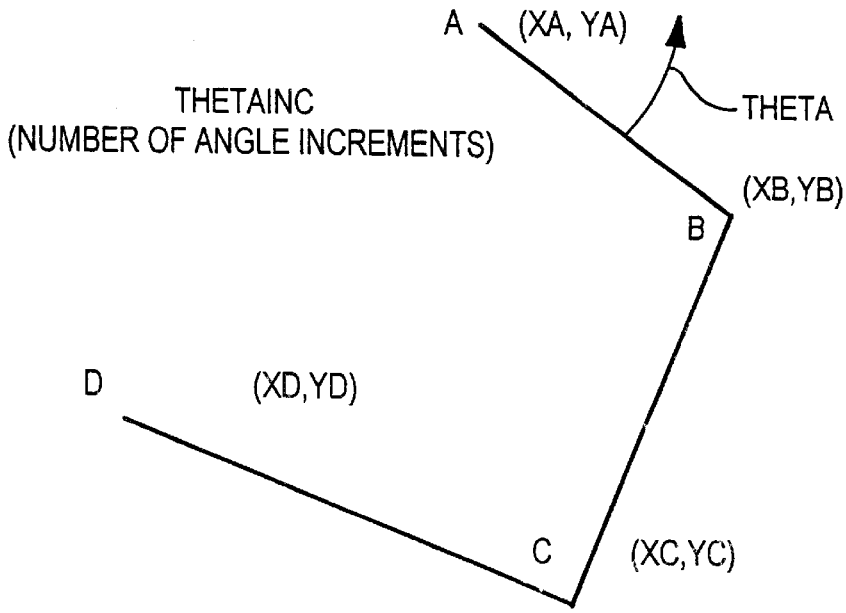
FIG. 7 illustrates schematically the determination of input variables for the computer program set forth in the appendix hereto.
Figure 8:
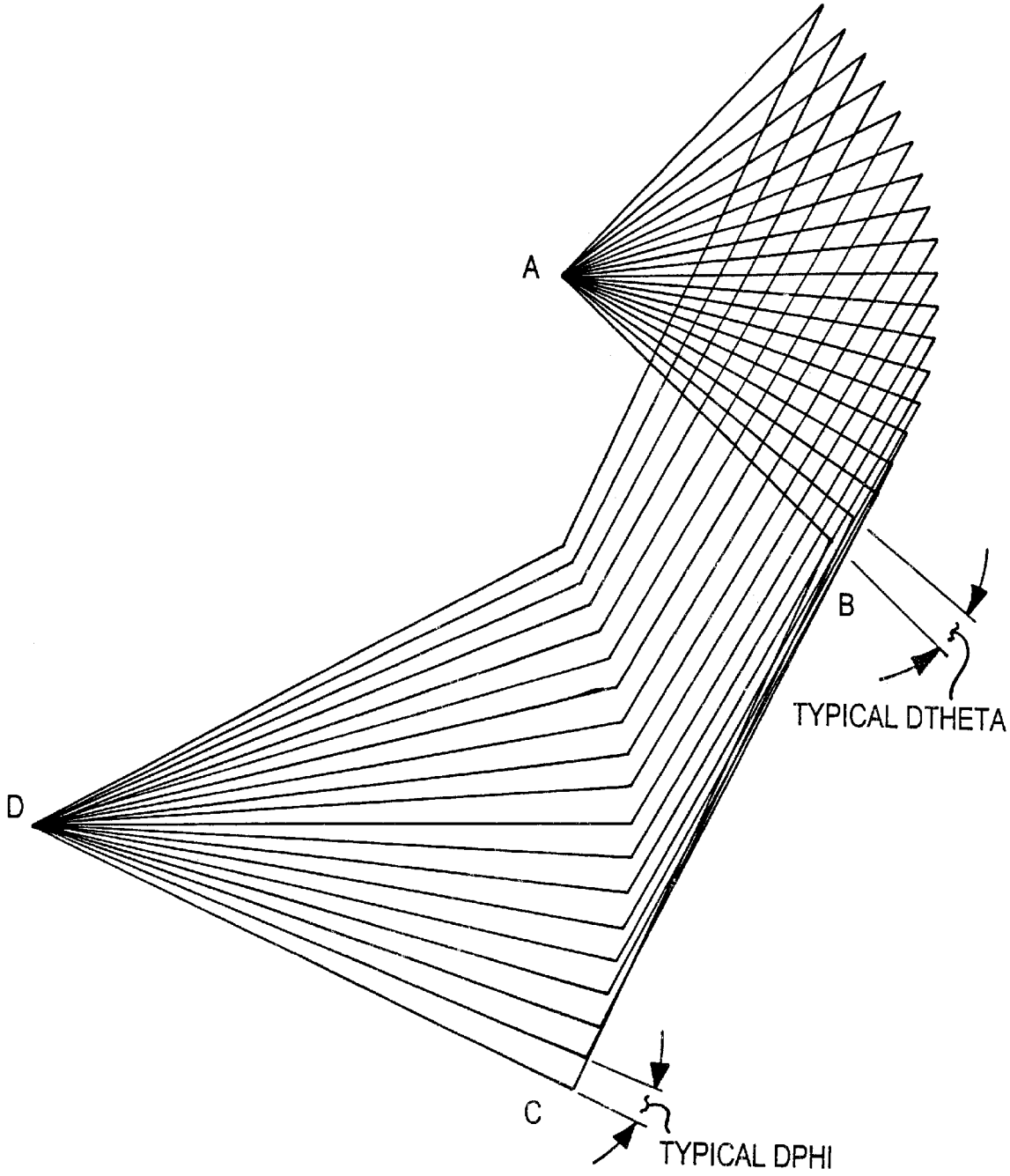
FIG. 8 illustrates the changes in positions of the linkage assembly upon incremental change in the angle theta of the exercise arm.

In one embodiment, the relative distances and angles of the shaft 15, 16, and 21 were chosen/optimized using the computer program set forth in the appendix hereto (in the FORTRAN computer language) that was developed to calculate the degree of rotation of torque arm assembly shaft 17 for given degrees of rotation of exercise arm 14. When the positions of shafts 13, 15, 16, and 21 (the points of rotation of the links; points A, B, C and D, respectively) in two-dimensional space are entered in the program, the program calculates, for example, the length of link 22, the distance between shafts 13 and 15 connected to exercise arm 14, the distance between shafts 16 and 21 of connected to torque arm or shaft 17, the degree of rotation of the torque arm assembly shaft 17 for given incremental degrees of rotation of exercise arm 14, the percentage of torque for such increments of rotation exercise arm 14, and the percentage of maximum resistance for each torque arm weight pegs 18, 19, and 20 at the increments of rotation exercise arm assembly 14 (see, for example, FIGS. 6, 7 and 8 and Tables 1 through 6 below) . The positions of shafts 13, 15, 16, and 21 (points A, B, C and D, respectively) were adjusted until a desired output (that is, an approximate match of the resistance curve that would be experienced in a linear conversion for each force curve) was achieved throughout the range of motion of exercise arm 14.

In general, the computer program determines the angle of rotation phi ($\Phi$) of the linkage assembly about point D (the point about which torque arm assembly shaft 17 rotates) as a function of the angle of rotation theta ($\theta$) of the linkage about point A (the point about which exercise arm 14 rotates). The values are preferably determined at a specified number of intermediate points. The angle of rotation theta of torque arm 14 is used to calculate the effective resistance transmitted by weights positioned on each of torque arms 18, 19 and 20 at the incremental angles with respect to a global reference (that is, a point in x, y two-dimensional space) as described above. As described above, point C is the point at which link 22 rotates about shaft 21, while point B is the point at which link 22 rotates about shaft 15. The input variables and the motion of the linkage assembly are described in FIGS. 6, 7 and 8.

Table 1 below sets forth one set of variables that was used in one embodiment of the present invention.

TABLE 1

| | | |
|---|---|---|
| Coordinates of point "A",: | 6.000 | −5.000 |
| Coordinates of point "B": | .750 | −12.250 |
| Coordinates of point "C" | −7.750 | −15.000 |
| Coordinates of point "D" | 0.000 | 0.000 |
| Angle of arm #1: | 0.000 | |
| Angle of arm #2: | −35.000 | |
| Angle of arm #3: | −70.000 | |
| Length of link A–B: | 8.951 | |
| Length of link B–C: | 8.934 | |
| Length of link C–D: | 16.884 | |

TABLE 1-continued

| | |
|---|---|
| Orientation of A–B: | 234.090 |
| Orientation of D–C; | 242.676 |

In Table 1, the coordinates (x, y) of points A, B, C and D are provided in inches relative to point D as the origin or reference. The angles of torque arms 18, 19 and 20 are given in degrees with respect to the horizontal position being 0 degrees. The lengths of the links of the linkage assembly (as determined by points A, B, C, and D) are provided in inches.

For this set of parameters, corresponding values of theta and phi are provided in Table 2. In this embodiment, an approximately 2:1 conversion between the motion of exercise arm 14 and torque arm assembly 17 is achieved. In that regard, exercise arm 14 travels over a range of approximately 140 degrees, while torque arm assembly travels over a range of approximately 70 degrees.

TABLE 2

| Theta | Phi | dPhi | Median Phi | Link % |
|---|---|---|---|---|
| 10.00 | 4.77 | 4.77 | 2.38 | 84.22 |
| 20.00 | 10.00 | 5.23 | 7.38 | 92.37 |
| 30.00 | 15.49 | 5.49 | 12.74 | 96.99 |
| 40.00 | 21.11 | 5.62 | 18.30 | 99.30 |
| 50.00 | 26.78 | 5.66 | 23.94 | 100.00 |
| 60.00 | 32.41 | 5.64 | 29.59 | 99.54 |
| 70.00 | 37.98 | 5.57 | 35.20 | 98.28 |
| 80.00 | 43.44 | 5.47 | 40.71 | 96.52 |
| 90.00 | 48.80 | 5.35 | 46.12 | 94.54 |
| 100.00 | 54.04 | 5.24 | 51.42 | 92.61 |
| 110.00 | 59.20 | 5.15 | 56.62 | 91.04 |
| 120.00 | 64.30 | 5.10 | 61.75 | 90.11 |
| 130.00 | 69.40 | 5.10 | 66.85 | 90.14 |
| 140.00 | 74.58 | 5.18 | 71.99 | 91.54 |

From the values of theta provided above, the normalized resistance (provided as the percent of maximum resistance) of each of torque arms 18 (lower), 19 (middle) and 20 (upper) are provided Tables 3, 4 and 5 respectively. Table 6 summarizes the data of Tables 3, 4 and 5 as related to the angle of rotation of exercise arm 14.

TABLE 3

| Median Phi | Arm 18 Angle | Torque % | Result Resist | % Max Resist |
|---|---|---|---|---|
| 2.38 | −67.62 | 38.08 | 32.07 | 35.06 |
| 7.38 | −62.62 | 45.99 | 42.48 | 46.44 |
| 12.74 | −57.26 | 54.09 | 52.46 | 57.35 |
| 18.30 | −51.70 | 61.98 | 61.55 | 67.28 |
| 23.94 | −46.06 | 69.40 | 69.40 | 75.86 |
| 29.59 | −40.41 | 76.15 | 75.80 | 82.86 |
| 35.20 | −34.80 | 82.11 | 80.70 | 88.22 |
| 40.71 | −29.29 | 87.22 | 84.18 | 92.02 |
| 46-12 | −23.88 | 91.44 | 86.44 | 94.50 |
| 51.42 | −18.58 | 94.79 | 87.79 | 95.96 |
| 56.62 | −13.38 | 97.28 | 88.57 | 96.82 |
| 61.75 | −8.25 | 98.96 | 89.17 | 97.48 |
| 66.85 | −3.15 | 99.85 | 90.01 | 98.39 |
| 71.99 | 1.99 | 99.94 | 91.48 | 100.00 |

TABLE 4

| Median Phi | Arm 19 Angle | Torque % | Result Resist | % Max Resist |
|---|---|---|---|---|
| 2.38 | −32.62 | 84.23 | 70.94 | 71.58 |
| 7.38 | −27.62 | 88.61 | 81.84 | 82.58 |
| 12.74 | −22.26 | 92.55 | 89.77 | 90.58 |
| 18.30 | −16.70 | 95.78 | 95.12 | 95.98 |
| 23.94 | −11.06 | 98.14 | 98.14 | 99.03 |
| 29.59 | −5.41 | 99.56 | 99.10 | 100.00 |
| 35.20 | .20 | 100.00 | 98.28 | 99.17 |
| 40.71 | 5.71 | 99.50 | 96.04 | 96.91 |
| 46.12 | 11.12 | 98.12 | 92.76 | 93.60 |
| 51.42 | 16.42 | 95.92 | 88.84 | 89.64 |
| 56.62 | 21.62 | 92.97 | 84.63 | 85.40 |
| 61.75 | 26.75 | 89.30 | 80.47 | 81.20 |
| 66.85 | 31.85 | 84.94 | 76.57 | 77.27 |
| 71.99 | 36.99 | 79.87 | 73.11 | 73.77 |

TABLE 5

| Median Phi | Arm 20 Angle | Torque Angle % | Result Resist | % Max Resist |
|---|---|---|---|---|
| 2.38 | 2.38 | 99.91 | 84.1S | 88.95 |
| 7.38 | 7.38 | 99.17 | 91.60 | 96.83 |
| 12.74 | 12.74 | 97.54 | 94.60 | 100.00 |
| 18.30 | 18.30 | 94.94 | 94.28 | 99.66 |
| 23.94 | 23.94 | 91.39 | 91.39 | 96.61 |
| 29.S9 | 29.59 | 86.95 | 86.56 | 91.50 |
| 35.20 | 35.20 | 81.72 | 80-32 | 84.90 |
| 40.71 | 40.71 | 75.80 | 73.16 | 77.34 |
| 46.12 | 46.12 | 69.32 | 65.53 | 69.27 |
| 51.42 | 51.42 | 62.36 | 57.76 | 61.05 |
| 56.62 | 56.62 | 55.02 | 50.09 | 52.95 |
| 61.75 | 61.75 | 47.34 | 42.65 | 45.09 |
| 66.85 | 66.85 | 39.31 | 35.44 | 37.46 |
| 71.99 | 71.99 | 30.91 | 28.30 | 29.91 |

TABLE 6

| Theta Degrees | Arm 20 (upper) | Arm 19 (middle) | Arm 18 (lower) |
|---|---|---|---|
| 10.00 | 88.95 | 71.58 | 35.06 |
| 20.00 | 96.83 | 82.58 | 46.44 |
| 30.00 | 100.00 | 90.58 | 57.35 |
| 40.00 | 99.66 | 95.8 | 67.28 |
| 50.00 | 96.61 | 99.03 | 75.86 |
| 60.00 | 91.50 | 100.00 | 82.86 |
| 70.00 | 84.90 | 99.17 | 88.22 |
| 80.00 | 77.34 | 96.91 | 92.02 |
| 90.00 | 69.27 | 93.60 | 94.50 |
| 100.00 | 61.05 | 89.64 | 95.96 |
| 110.00 | 52.95 | 85.40 | 96.82 |
| 120.00 | 45.09 | 81.20 | 97.48 |
| 130.00 | 37.46 | 77.27 | 98.39 |
| 140.00 | 29.91 | 73.77 | 100.00 |

Figure 9:
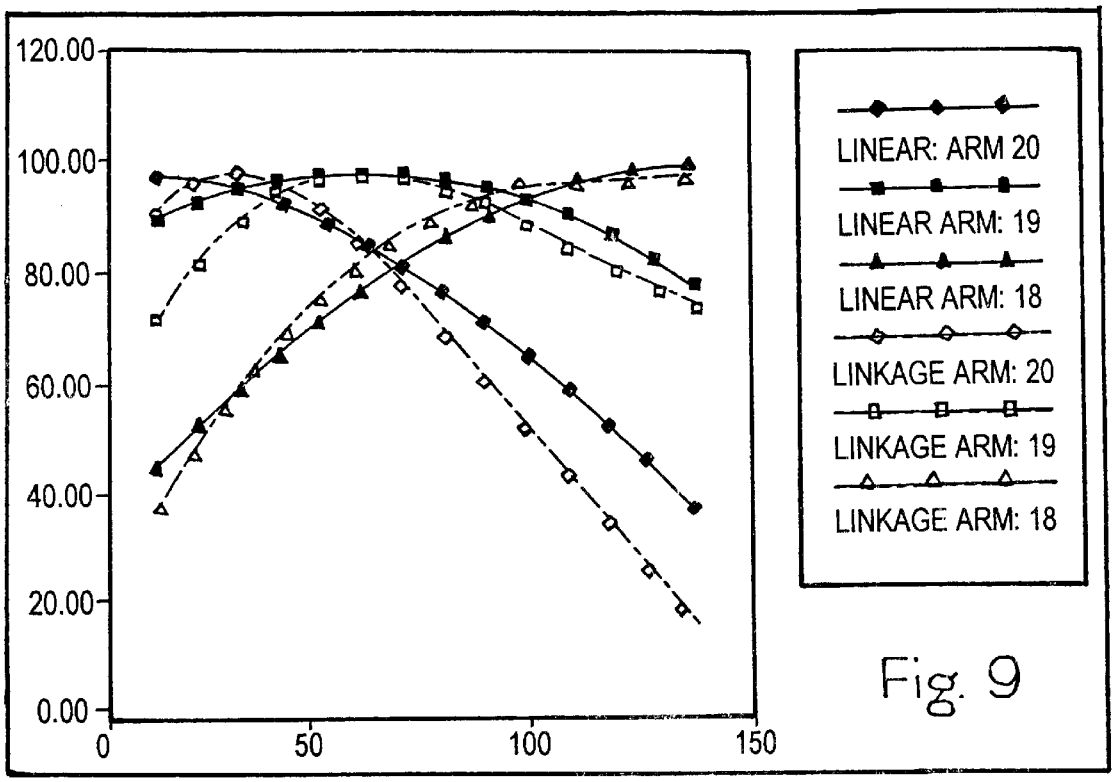
FIG. 9 illustrates a comparison of the resistance curves achieved in the present invention with the resistance curves achieved with use of a linear conversion mechanism for torque arms positioned at 0, −35, and −70 degrees with respect to the horizontal.

As illustrated in the summarized data of Table 6 and in FIG. 9, the general shape of the normalized resistance curves for each of torque arms 18, 19 and 20 approximately matches the ideal resistance curve. In that regard, upper torque arm 20 provides a maximum normalized resistance near the beginning of the range of motion of exercise arm 14 and a minimum normalized resistance at the end of the range of motion. Middle torque arm 19 provides a maximum normalized resistance near the middle of the range of motion. Lower torque arm 18 provides a minimum normalized resistance at the beginning of the range of motion and a maximum normalized resistance at the end of the range of motion. In general, the normalized resistance for each of torque arms 18, 19 and 20 is within approximately 30%, of the ideal normalized resistance (that is, the normalized resistance that would result with a linear conversion mechanism such as a beltwheel assembly) over the range of motion. Indeed, the normalized resistance for each of torque arms 18, 19 and 20 is within approximately 15%, of the ideal normalized resistance over most of the range of motion. In that regard, FIG. 9 illustrates the normalize resistance curves of the exercise device of the present invention as compared to the resistance curves that would result with a linear conversion mechanism (for example, a beltwheel assembly) with a conversion ratio of 2 for the same torque arm angles.

Figure 10:
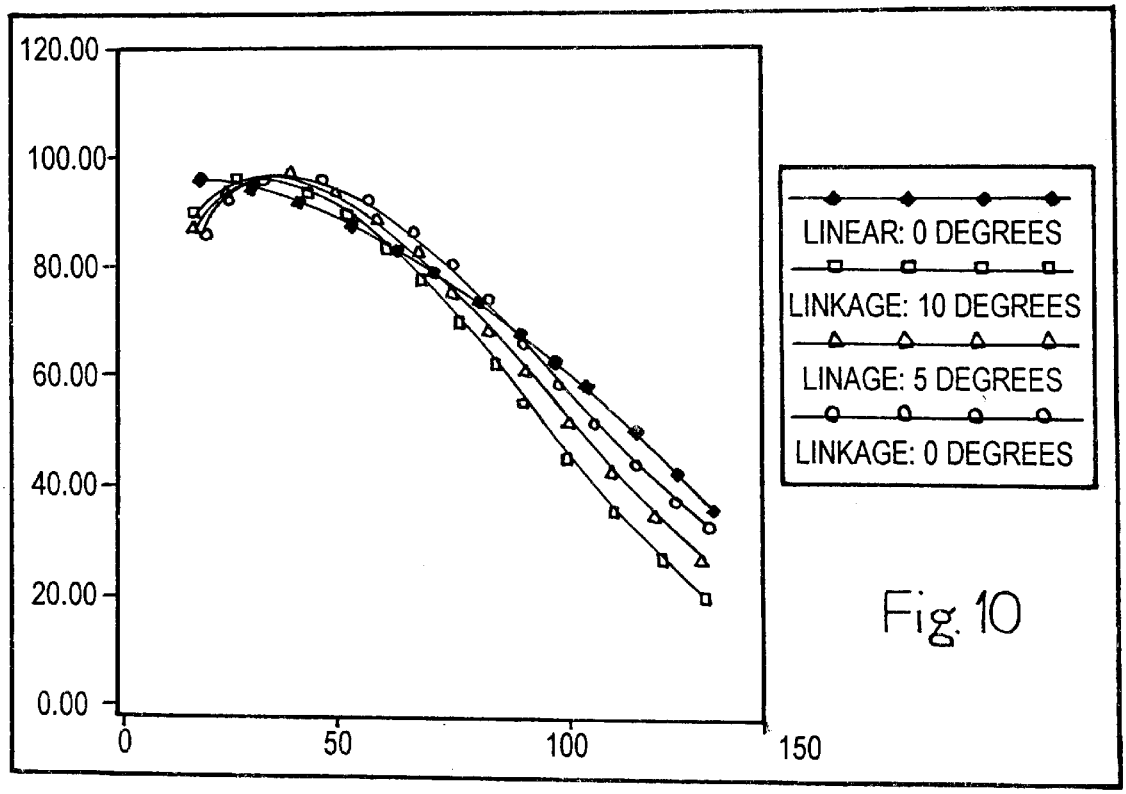
FIG. 10 illustrates a study of the change of angular orientation of the upper torque arm in an exercise device of the present invention.

In addition to adjustment of the position of the points of rotation of the linkage assembly as described above, one can also adjust the angle or one or more of torque arms 20, 19 or 18 to achieve a desired resistance curve. For example, as illustrated above, the resistance curve for torque arm 20 exhibits a maximum after a rotation of exercise arm 14 to 30 degrees rather than at the initiation of the exercise motion (0 degrees of rotation of exercise arm 14). FIG. 10 illustrates a study in which the angle of torque arm 20 is set at 0 degrees, 5 degrees and 10 degrees to study the effect thereof.

Although the present invention has been described in detail in connection with the above examples, it is to be understood that such detail is solely for that purpose and that variations can be made by those skilled in the art without departing from the spirit of the invention except as it may be limited by the following claims.

APPENDIX

```
      PROGRAM        TL
      IMPLICIT       NONE
C     This program determines the rotation of a linkage assembly about one
C     point ("D") as a function of the linkage rotation about another point
C     ("A"). These values are determined at a specified number of intermediate
C     points (THETAINC). These values are also used to determine the
C     effective force transmitted by weights on 3 arms at user specified angles
C     which are measured from a global reference (not with respect to the
C     angles of the linkage bars).
C
C
C
C
C
C
C
C     Platform:      IBM PC; DOS
C     Language:      MS Fortran version 5.0 or 5.1
C     Parameters:
      INTEGER*2      NSTEPMAX                          !
      PARAMETER      (NSTEPMAX = 101)                  !Maximum number of steps
      REAL*8         PI                                !
      PARAMETER      (PI = 3.14159265359)              !Pi
      INTEGER*2      NARMS                             !
      PARAMETER      (NARMS = 3)                       !Maximum number of arms
C     Input variables:
      REAL*8         XA, YA                            !Coordinates of point "A"
      REAL*8         XB, YB                            !Coordinates of point "B"
      REAL*8         XC, YC                            !Coordinates of point "C"
      REAL*8         XD, YD                            !Coordinates of point "D"
      REAL*8         THETA                             !Total angle moved about "A"
      INTEGER*2      THETAINC                          !Number of increments for
                                                       !stepping through theta
      REAL*8         ARMANGLE (NARMS)                  !Arm angles
C     Result variables:
      REAL*8         DPHI          (NSTEPMAX)          !Increments in PHI
      REAL*8         MEDPHI        (NSTEPMAX)          !Average PHI angle
      REAL*8         ARMPHI        (NARMS,NSTEPMAX)    !PHI angles for the arms
      REAL*8         ARMTORQP      (NARMS,NSTEPMAX)    !Arm torque percent
      REAL*8         RESIST        (NARMS,NSTEPMAX)    !Total resistance
      REAL*8         RESISTP       (NARMS,NSTEPMAX)    !Percent of Maximum Total
                                                       !Resistance
      REAL*8         RESISTMX      (NARMS)             !Maximum Resistance for arms
C     Local variables:
      INTEGER*2      IOS                               !I/O Status
      REAL*8         DTHETA        (NSTEPMAX)          !Increments in THETA
      REAL*8         XBP           (NSTEPMAX)          !Intermediate XB coordinates
      REAL*8         YBP           (NSTEPMAX)          !Intermediate YB coordinates
!     REAL*8         XCP           (NSTEPMAX)          !Intermediate XC coordinates
!     REAL*8         YCP           (NSTEPMAX)          !Intermediate YC coordinates
      REAL*8         LDBP          (NSTEPMAX)          !Intermediate length from D to B
      REAL*8         ODBP          (NSTEPMAX)          !Intermediate orientation from D to B
      REAL*8         OABP          (NSTEPMAX)          !Intermediate orientation from A to B
      REAL*8         ODCP          (NSTEPMAX)          !Intermediate orientation from D to C
      REAL*8         ABDC          (NSTEPMAX)          !Intermediate angle BDC
      REAL*8         PERMAXP       (NSTEPMAX)          !Percent of maximum phi angle
      REAL*8         DPHIMAX                           !Maximum DPHI angle
      REAL*8         LAB                               !Length from "A" to "B"
      REAL*8         LBC                               !Length from "B" to "C"
      REAL*8         LCD                               !Length from "C" to "D"
      REAL*8         OAB                               !Orientation of vector AB
```

APPENDIX-continued

```
      REAL*8          ODC                                  !Orientation of vector DC
      REAL*8          ATEMP                                !Temporary angle
      REAL*8          DPR                                  !Degrees per radian
      INTEGER*2       TT, JJ                               !Array subscripts
      LOGICAL*1       TEST                                 !True if running test case data
      REAL*8          TOLER                                !Tolerance (percent)
      PARAMETER       (TOLER=0.000001D0)                   !
C     Initialize variables:
      DPR     = 180.0 / PI
      TEST    = .FALSE.
      TEST    = .TRUE.
C     Open output file:
C     OPEN    (2,FILE='INPUT.DAT')
      OPEN    (3,FILE='OUTPUT.DAT',STATUS='NEW',IOSTAT=IOS)
      IF (IOS .EQ. 6415) THEN
          OPEN    (3,FILE='OUTPUT.DAT',STATUS='OLD',IOSTAT=IOS)
          CLOSE   (3,STATUS='DELETE')
          OPEN    (3,FILE='OUTPUT.DAT',STATUS='NEW',IOSTAT=IOS)
      ENDIF
C     Get input from user:
      IF (TEST) THEN                                       !These values used only for test
          XA              =    7.00
          YA              =    4.50
          XB              =    4.26
          YB              =   -4.07
          XC              =    0.00
          YC              =  -12.00
          XD              =    0.00
          YD              =    0.00
          THETA           =  140.00
          THETAINC        =   14
          ARMANGLE (1)    =  -70.0
          ARMANGLE (2)    =  -35.0
          ARMANGLE (3)    =    0.0
      ELSE                                                 !Get input values from user
          WRITE   (*,700)
          WRITE   (*,701)
          READ    (*,*)       XA
          WRITE   (*,702)
          READ    (*,*)       YA
          WRITE   (*,703)
          READ    (*,*)       XB
          WRITE   (*,704)
          READ    (*,*)       YB
          WRITE   (*,705)
          READ    (*,*)       XC
          WRITE   (*,706)
          READ    (*,*)       YC
          WRITE   (*,707)
          READ    (*,*)       XD
          WRITE   (*,708)
          READ    (*,*)       YD
          WRITE   (*,709)
          READ    (*,*)       THETA
          WRITE   (*,710)
          READ    (*,*)       THETAINC
          DO II = 1, NARMS
              WRITE   (*,711) II
              READ    (*,*) ARMANGLE (II)
          ENDDO
      ENDIF
C     Summarize user input:
      WRITE   (*,741)     XA, YA
      WRITE   (*,742)     XB, YB
      WRITE   (*,743)     XC, YC
      WRITE   (*,744)     XD, YD
      WRITE   (3,741)     XA, YA
      WRITE   (3,742)     XB, YB
      WRITE   (3,743)     XC, YC
      WRITE   (3,744)     XD, YD
      DO II = 1, NARMS
          WRITE   (*,745)     II, ARMANGLE (II)
          WRITE   (3,745)     II, ARMANGLE (II)
      ENDDO
C     Calculate geometric parameters:
      LAB         = SQRT      (((XA-XB)**2)+((YA-YB)**2))
      LBC         = SQRT      (((XB-XC)**2)+((YB-YC)**2))
      LCD         = SQRT      (((XC-XD)**2)+((YC-YD)**2))
      CALL ORIENT (XA,YA,XB,YB,OAB)
```

APPENDIX-continued

```
      CALL ORIENT (XD,YD,XC,YC,ODC)
      WRITE  (*,721)     LAB
      WRITE  (*,722)     LBC
      WRITE  (*,723)     LCD
      WRITE  (*,724)     OAB
      WRITE  (*,725)     ODC
      WRITE  (3,721)     LAB
      WRITE  (3,722)     LBC
      WRITE  (3,723)     LCD
      WRITE  (3,724)     OAB
      WRITE  (3,725)     ODC
C     Loop through the angle increments:
      WRITE  (*,730)
      WRITE  (3,730)
      DPHIMAX = 0.0
      DO II = 1, THETAINC
          DTHETA   (II)  = II * (THETA/FLOAT(THETAINC))
          OABP     (II)  = OAB + DTHETA (II)
          XBP      (II)  = XA + LAB * COS (OABP (II) / DPR)
          YBP      (II)  = YA + LAB * SIN (OABP (II) / DPR)
          LDBP     (II)  = SQRT (((XBP(II)-XD)**2)+((YBP(II)-YD)**2))
          CALL    ORIENT      (XD,YD,XBP(II),YBP(II),ODBP(II))
          ATEMP          = (LDBP(II)**2 + LCD**2 - LBC**2)
          ATEMP          = ATEMP / (2.0*LDBP(II)*LCD)
          ABDC     (II)  = DPR * ACOS (ATEMP)
          ODCP     (II)  = ODBP (II) - ABDC (II)
          CALL    DANGLE      (ODC, ODCP (II), DPHI (II))
          IF          (II .EQ. 1) THEN
              ATEMP          = DPHI (II)
              MEDPHI   (II)  = ATEMP/2.0
          ELSE
              ATEMP          = DPHI (II) - DPHI (II-1)
              MEDPHI   (II)  = DPHI (II-1) + ATEMP/2.0
          ENDIF
          IF (ATEMP .GT. DPHIMAX) DPHIMAX = ATEMP
      ENDDO
C     Loop through angle increments:
      DO II = 1, THETAINC
          IF        (II .EQ. 1) THEN
              ATEMP     = DPHI (II)
          ELSE
              ATEMP     = DPHI (II) - DPHI (II-1)
          ENDIF
!         PERMAXP (II) = 100.0*ATEMP*FLOAT(THETAINC)/DPHI(THETAINC)
          PERMAXP (II) = 100.0*ATEMP/DPHIMAX
          WRITE  (*,731)  DTHETA     (II), DPHI (II), ATEMP, MEDPHI (II),
*                         PERMAXP    (II)
          WRITE  (3,731)  DTHETA     (II), DPHI (II), ATEMP, MEDPHI (II),
*                         PERMAXP    (II)
      ENDDO
      DO II = 1, NARMS
          RESISTMX (II) = 0.0
          DO JJ = 1, THETAINC
              ARMPHI         (II,JJ) = ARMANGLE (II) + MEDPHI (JJ)
              ARMTORQP       (II,JJ) = 100.0 * COS ((ARMPHI(II,JJ)) / DPR)
              RESIST         (II,JJ) = (ARMTORQP(II,JJ)*PERMAXP(JJ))/100.
              IF (RESIST (II,JJ) .GT. RESISTMX (II)) THEN
                  RESISTMX (II) = RESIST (II,JJ)
              ENDIF
          ENDDO
      ENDDO
      DO II = 1, NARMS
          WRITE  (*,732)  II
          WRITE  (3,732)  II
          WRITE  (*,733)
          WRITE  (3,733)
          DO JJ = 1, THETAINC
              RESISTP (II,JJ) = 100.0 * (RESIST (II,JJ) / RESISTMX (II))
              WRITE  (*,734)  MEDPHI   (JJ), ARMPHI (II,JJ), ARMTORQP (II,JJ),
*                             RESIST   (II,JJ), RESISTP (II,JJ)
              WRITE  (3,734)  MEDPHI   (JJ), ARMPHI (II,JJ), ARMTORQP (II,JJ),
*                             RESIST   (II,JJ), RESISTP (II,JJ)
          ENDDO
      ENDDO
      WRITE  (*,751)
      WRITE  (3,751)
      WRITE  (*,752)
      WRITE  (3,752)
      DO II = 1, THETAINC
```

APPENDIX-continued

```
          WRITE  (*,753)   DTHETA (II), RESISTP (1,II), RESISTP (2,II),
     *                     RESISTP (3,II)
          WRITE  (3,753)   DTHETA (II), RESISTP (1,II), RESISTP (2,II),
     *                     RESISTP (3,II)
     ENDDO
C    Printing Format Statements:
700  FORMAT  ( 2X,'"A" is where rotation is imposed.'/
     2          2X,'"D" is where rotation is to be determined.'/
     3          2X,'Points "A" and "D" are fixed.'/
     4          2X,'"B" is connected by one link to "A".'/
     5          2X,'"C" is connected by one link to "D".'/)
701  FORMAT  ( 2X,'Enter the x coordinate of point "A":'\)
702  FORMAT  ( 2X,'Enter the y ccordinate of point "A":'\)
703  FORMAT  ( 2X,'Enter the x coordinate of point "B":'\)
704  FORMAT  ( 2X,'Enter the y coordinate of point "B":'\)
705  FORMAT  ( 2X,'Enter the x coordinate of point "C":'\)
706  FORMAT  ( 2X,'Enter the y coordinate of point "C":'\)
707  FORMAT  ( 2X,'Enter the x coordinate of point "D":'\)
708  FORMAT  ( 2X,'Enter the y coordinate of point "D":'\)
709  FORMAT  ( 2X,'Enter the total angle for point "A":'\)
710  FORMAT  ( 2X,'Enter the number of angle increments:'\)
711  FORMAT  ( 2X,'Enter the starting angle for arm #',I2,':'\)
721  FORMAT  ( 2X,'Length of link A–B:          ',F8.3)
722  FORMAT  ( 2X,'Length of link B–C:          ',F8.3)
723  FORMAT  ( 2X,'Length of link C–D:          ',F8.3)
724  FORMAT  ( 2X,'Orientation of A–B:          ',F8.3)
725  FORMAT  ( 2X,'Orientation of D–C:          ',F8.3)
730  FORMAT  (/'        Theta       Phi       dPhi      Median      Link'/
     *         '                                          Phi         %')
731  FORMAT  (5F9.2)
732  FORMAT  (/'     Output from arm #',I2,':')
733  FORMAT  ( '        Median      Arm      Torque     Result     % Max'/
     *         '          Phi      Angle       %        Resist     Resist')
734  FORMAT  (5F9.2)
741  FORMAT  ( '     Coordinates of point "A":',2F8.3)
742  FORMAT  ( '     Coordinates of point "B":',2F8.3)
743  FORMAT  ( '     Coordinates of point "C":',2F8.3)
744  FORMAT  ( '     Coordinates of point "D":',2F8.3)
745  FORMAT  ( '     Angle of arm #',I2,':      ',F8.3)
751  FORMAT  (/'     Summary of Normalized Resistance:')
752  FORMAT  ( '        Theta      Arm #1    Arm #2    Arm #3   '/
     *         '     Degrees ')
753  FORMAT  (4F9.2)
800  FORMAT  ( '     * * * WARNING * * *')
900  FORMAT  ( '     * * * ERROR * * *')
901  FORMAT  ( '     Internal programming error.')
     STOP
     END
```

What is claimed is:

1. An exercise device for generating a plurality of resistance curves comprising: a support frame, a first shaft rotatably supported on the support frame, a user interface member connected to the first shaft which, when displaced by a user, causes the first shaft to rotate more than 90 degrees, a second shaft rotatably supported on the support frame; a linkage mechanism causing a variable resistance force connecting the first shaft and the second shaft and controlling the relative rates of rotation of the first and second shafts, and a torque arm assembly including at least an upper torque arm and a lower torque arm connected to the second shaft at different predetermined angular positions, each torque arm including at least one weight support member thereon, the relative positions of the connections within the linkage mechanism being coordinated with the relative angular positions of each torque arm such that when the user interface member is displaced by the user:

the aggregate effect of the linkage mechanism and a weight member on the upper torque arm causes: (i) a maximum torque to be applied to the first shaft at some point during the first 45 degrees of rotation of the first shaft; and (ii) a minimum torque to be applied to the first shaft at some point during the last 45 degrees of rotation of the first shaft;

the aggregate effect of the linkage mechanism and a weight member on the lower torque arm causes: (i) a maximum torque to be applied to the first shaft at some point during the last 45 degrees of rotation of the first shaft; and (ii) a minimum torque to be applied to the first shaft at some point during the first 45 degrees of rotation of the first shaft; and wherein the resistance generated by the linkage mechanism and torque arm assembly does not result in a negative resistance force at any point during the rotation of the first shaft.

2. The exercise device described in claim 1 wherein an independent weight member on each of the torque arms is linearly positionable thereon.

3. The exercise device described in claim 1 wherein the weight support member of each of the torque arms includes a weight attachment member to which weight members can be removably secured.

4. The exercise device of claim 1 further including at least one intermediate torque arm connected to the second shaft at a predetermined angular positions intermediate to the upper torque arm and the lower torque arm, the intermediate torque arm comprising a weight support member thereon; the relative positions of the connections within the linkage mechanism being coordinated with the relative angular positions of the intermediate torque arm such that when the user interface member is displaced by the user;

the aggregate effect of the linkage mechanism and a weight positioned on the intermediate torque arm causes a maximum torque force to be applied to the first shaft at some point during the middle 45 degrees of rotation of the first shaft;

wherein the resistance generated by the linkage mechanism and torque arm assembly does not result in a negative resistance force at any point during the rotation of the first shaft.

5. The exercise device described in claim 4 wherein the torque arm assembly includes a second intermediate torque arm at a different angular position from the other intermediate torque arm torque arms.

6. The exercise device described in claim 4 wherein an independent weight member on each of the torque arms is linearly positionable thereon.

7. The exercise device described in claim 4 wherein the weight support member of each of the torque arms includes a weight attachment member to which weight members can be removably secured.

8. The exercise device of claim 1 wherein the linkage assembly being is adapted to minimize the nonlinear effect thereof on the resistance curves.

9. The exercise device described in claim 1 wherein the conversion mechanism enables the torque arm assembly to rotate up to approximately 70 degrees.

10. A method of designing a linkage assembly for use in an exercise device including a torque arm assembly, the torque arm assembly including multiple torque arms positioned at different angular positions, each of the plurality of torque arms including a support to position a weight member thereon; a user interface member connected to an exercise arm assembly that, when displaced by a user, causes the exercise arm assembly to rotate, and a conversion mechanism including the linkage assembly connecting the exercise arm assembly and the torque arm assembly, the conversion mechanism controlling the degree of rotation of the torque arm assembly, comprising the steps of:

mapping a first set of points corresponding the points of rotation of links of the linkage assembly into two dimensional space; and calculating the resistance curve experienced by the exercise arm for each of a plurality of torque arms positioned at different angular positions at incremental positions along a range of motion of the exercise arm for the first set of points.

11. The method of claim 1 further comprising the steps of:

changing the location of the location of the points of rotation in two-dimensional space to create at least a second set of point; and calculating the resistance curve experienced by the exercise arm for each of the plurality of torque arms at incremental positions along a range of motion of the exercise arm for the second set of points.

12. The method of claim 11 wherein the steps thereof are repeated.

* * * * *

UNITED STATES PATENT AND TRADEMARK OFFICE

CERTIFICATE OF CORRECTION

PATENT NO. : 6,517,468 B1
DATED : February 11, 2003
INVENTOR(S) : Thomas G. Lapcevic It is certified that error appears in the above-identified patent and that said Letters Patent is hereby corrected as shown below:

Column 2,
Lines 26-27, “exercised device” should read -- exercise device --.
Line 36, “experience” should read -- experienced --.

Column 4,
Line 2, “possible adapt” should read -- possible to adapt --.

Column 5,
Line 12, “desire” should read -- desired --.
Line 14, “ration” should read -- ratio --.
Line 17, “1.75” should read -- 1.75. --.
Line 36, “point” should read -- points --.

Column 6,
Line 40, “location” should read -- locations --.

Column 7,
Line 29, “that” should read -- than --.
Line 47, “motion)” should read -- motion). --.
Line 49, “and ends and ends” should read -- and ends --.

Column 8,
Line 10, “assembly” should read -- assembly has --.

Column 9,
Lines 10-11, “may occupied” should read -- may be occupied --.

Column 10,
Line 24, “21 of” should read -- 21 --.

Column 12,
Table 5, in Column 1, “29.S9” should read -- 29.59 --.
Table 5, in Column 4, “84.1S” should read -- 84.15 --.

UNITED STATES PATENT AND TRADEMARK OFFICE

CERTIFICATE OF CORRECTION

PATENT NO. : 6,517468 B1 
DATED : February 11, 2003
INVENTOR(S) : Thomas G. Lapcevic It is certified that error appears in the above-identified patent and that said Letters Patent is hereby corrected as shown below:

Column 13,
Line 6, “normalize” should read -- normalized --.

Column 20,
Line 64, “positions” should read -- position --.

Column 21,
Line 16, “torque arm torque arms” should read -- torque arm --.
Line 25, “being is” should read -- is --.

Column 22,
Line 20, “claim 1” should read -- claim 10 --.
Line 23, “point” should read -- points --.

Signed and Sealed this

Ninth Day of September, 2003

JAMES E. ROGAN
*Director of the United States Patent and Trademark Office*